US006998555B2

(12) United States Patent
Collot et al.

(10) Patent No.: US 6,998,555 B2
(45) Date of Patent: Feb. 14, 2006

(54) MINISWITCH

(75) Inventors: Stéphane Collot, Chateaudouble (FR); Bernard Truchet, Besayes (FR); Christian Roux, Montmeyran (FR)

(73) Assignee: Crouzet Automatismes, Valence (FR)

( * ) Notice: Subject to any disclaimer, the term of this patent is extended or adjusted under 35 U.S.C. 154(b) by 0 days.

(21) Appl. No.: 10/976,889

(22) Filed: Nov. 1, 2004

(65) Prior Publication Data

US 2005/0109601 A1 May 26, 2005

(30) Foreign Application Priority Data

Nov. 20, 2003 (FR) ..... 03 13600

(51) Int. Cl.
*H01H 13/36* (2006.01)

(52) U.S. Cl. ..... 200/412; 200/402

(58) Field of Classification Search ..... 200/402, 200/406, 407–412, 417, 422, 425, 434–440, 200/445, 453, 454, 468
See application file for complete search history.

(56) References Cited

U.S. PATENT DOCUMENTS

| | | | | |
|---|---|---|---|---|
| 3,773,991 A | * | 11/1973 | Krieger et al. | 200/83 P |
| 4,145,587 A | * | 3/1979 | Purssell | 200/407 |
| 4,543,459 A | | 9/1985 | Hayashida | 200/67 |
| 5,086,198 A | * | 2/1992 | Arakawa | 200/456 |
| 5,089,715 A | * | 2/1992 | Kokubu | 200/459 |
| 5,181,603 A | | 1/1993 | Mori et al. | 200/302.1 |
| 5,566,819 A | | 10/1996 | Lustgarten et al. | 200/407 |
| 5,950,811 A | * | 9/1999 | Kautz et al. | 200/407 |

FOREIGN PATENT DOCUMENTS

| | | | |
|---|---|---|---|
| DE | 198 34 888 A1 | | 2/2000 |
| DE | 19834888 A1 | * | 2/2000 |
| EP | 0 789 373 A1 | | 8/1997 |
| EP | 789373 A1 | * | 8/1997 |
| FR | 2 520 922 | | 8/1983 |

* cited by examiner

*Primary Examiner*—Lincoln Donovan
*Assistant Examiner*—M. Fishman
(74) *Attorney, Agent, or Firm*—Steptoe & Johnson LLP

(57) ABSTRACT

An electrical miniswithch comprising a case including a case part forming a base having several electrical terminals extending therefrom, and a case part forming a cover, an instantaneous switching mechanism located in the case and comprising a flexible conducting blade subjected to a substantial pre-stress, and a push-button mounted sliding through the part of the case forming the cover to actuate the instantaneous mechanism. The miniswitch also comprises a compression spring opposing sliding of the push-button so that in the break position of the miniswitch the flexible conducting blade is biased by th push-button and the spring, retained by a stop on the push-button, and in the switched or make position of the miniswitch the conducting blade is not subjected to constraint from the push-button and the compression spring.

6 Claims, 4 Drawing Sheets

MINISWITCH

BACKGROUND OF THE INVENTION

The invention relates to a miniswitch, i.e. a device of small dimensions performing an electrical current switching function.

STATE OF THE ART

Miniswitches are frequently used in a large number of fields of activity having recourse to electrical current switching functions, such as automobile construction or household appliances. Depending on the function performed, they may be contactor devices which establish an electrical current when they are actuated, breaking devices which break an electrical current when they are actuated, or changeover switches which switch two electrical currents depending on whether they are in their break state or in their make state.

The invention concerns miniswitches comprising a high-speed breaking mechanism actuated by a push-button. Such a miniswitch according to the state of the art is for example described in the documents DE 19,834,888, U.S. Pat. No. 5,181,603 or EP 0,789,373.

Regardless of the function it performs, the miniswitch must meet as best as possible constraints that are often conflicting as far as cost, dimensions, reliability and ease of implementation are concerned. In particular, it must be of small dimensions, and at the same time provide the push-button with the largest over-travel possible in order to facilitate or avoid mechanical adjustments to the system in which it is to be used; the over-travel being the distance that the push-button can cover after the device has switched.

Thus, the miniswitches described in the documents DE 19,834,888 and U.S. Pat. No. 5,181,603 only provide a small over-travel of the push-button. Furthermore, during the over-travel, the push-button will exert an increasingly large mechanical force on the switching mechanism, which further reduces the mechanical reliability of the miniswitch. The miniswitch device described in the document EP 0,789,373 provides a large over-travel of the push-button, but the switching mechanism is subjected to stresses and strains all along this over-travel, which is detrimental to the mechanical reliability of the device causing the blade to fatigue and reducing its endurance. Moreover the friction occurring at the level of the contact accelerates the wear of the surface treatments and reduces the lifetime of the device. Finally, the mechanical forces exerted by the blade on the push-button give rise to a great deal of friction.

SUMMARY OF THE INVENTION

It is therefore the object of the invention to remedy the shortcomings of state-of-the-art miniswitches, enabling a large over-travel of the push-button while ensuring an excellent electrical and mechanical reliability due to a reduction of the fatigue of the components.

For this purpose, it is an object of the invention to provide an electrical miniswitch comprising a case including a part forming a cover and a part forming a base wherefrom several electrical terminals are salient, an instantaneous switching mechanism placed in the case and comprising a flexible conducting blade subjected to a substantially longitudinal pre-stress, and a push-button mounted sliding through the part of the case forming the cover so as to actuate the instantaneous switching mechanism, and also comprising a compression spring opposing sliding of the push-button, the flexible conducting blade being kept biased by the push-button and the compression spring by means of a stop placed on the push-button in the break position of the miniswitch, and the conducting blade being released from any constraint from the push-button and the compression spring in the make position of the miniswitch.

According to a particularly simple embodiment, the push-button passes through the flexible conducting blade.

Advantageously, one end of the compression spring is housed in a recess of the push-button.

Optionally, the flexible conducting blade is pre-stressed by fitting between two notches or between a notch and a retaining fold.

BRIEF DESCRIPTION OF THE FIGURES

Other advantages and features will become more clearly apparent from the following description of particular embodiments of the invention, given as non-restrictive examples only and represented in the accompanying drawings in which.

DETAILED DESCRIPTION OF AN EMBODIMENT

Figure 1:
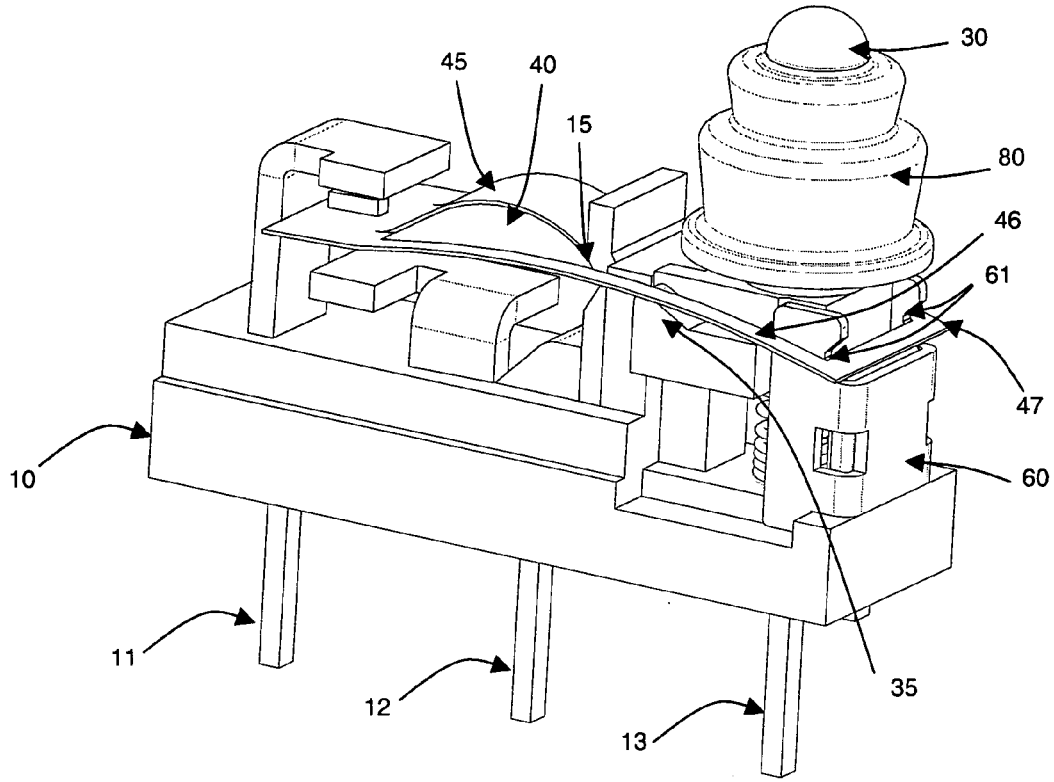
FIG. 1 represents an elevation of a first miniswitch according to the invention without the part of the case forming the cover.

A first embodiment of a miniswitch according to the invention is represented in FIGS. 1 to 4. The miniswitch comprises a case composed of a part forming a base (10) wherefrom several electrical terminals (11, 12, 13) are salient, and a part forming a cover (20).

A high-speed breaking mechanism is placed in the case and performs the switching function corresponding to a contactor, a make-and-break mechanism or a changeover switch according to the application. This switching mechanism comprises in conventional manner a flexible conducting blade (40) comprising a tongue (45) subjected to a substantially longitudinal pre-stress. Depending on the position of the miniswitch, the blade enables an electrical connection to be established between a terminal (13) and one of the other two terminals (11) and (12). In this embodiment, the flexible conducting blade (40) comprises a tongue (45) and two branches (46, 47) separated by a recess. The free end of the tongue (45) is inserted in a first notch (15) located on the part of the case forming the base (10) and the two branches (46, 47) are inserted in a second notch (61) located on an add-on part (60) so as to subject the tongue (45) to a substantially longitudinal mechanical pre-stress that tends to keep the movable end of the flexible conducting blade (40) pressed against the contact (70) located closer to the base (10).

A push-button (30) is mounted sliding in the part of the case forming the cover (20) so as to actuate the switching mechanism. A compression spring (50) is placed between the case forming the base (10) and the push-button (30) in such a way that it opposes sliding of the push-button (30)

over the whole travel, and that it exerts a return force when the push-button (30) is in the break position.

Figure 2:
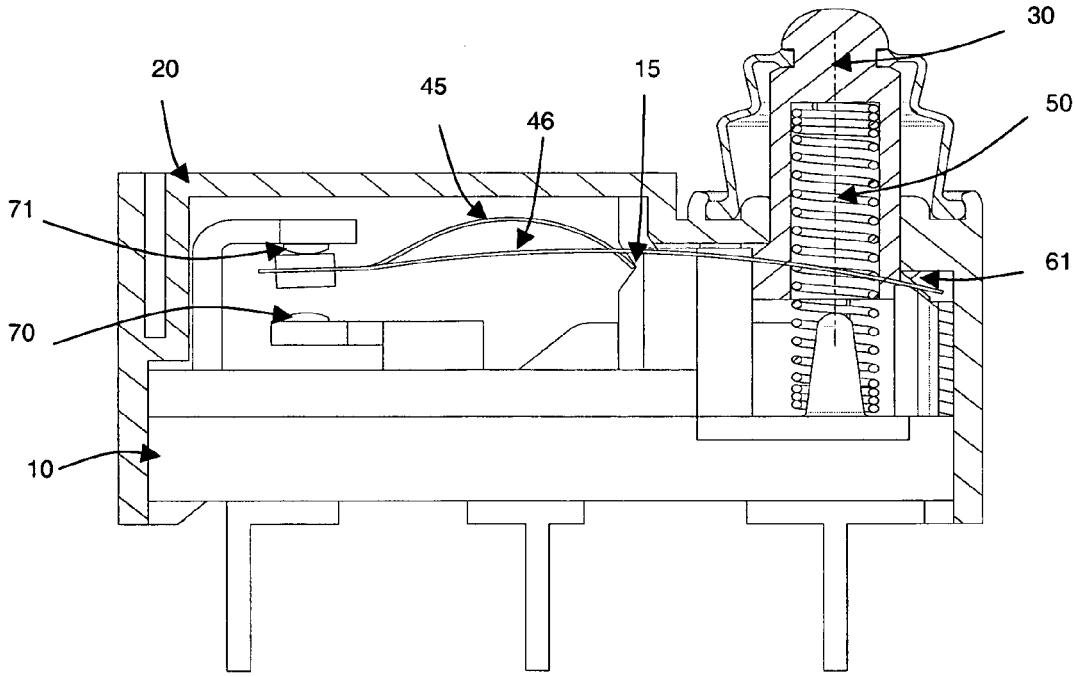
FIG. 2 represents a partial cross-section of the miniswitch of FIG. 1.
Figure 3:
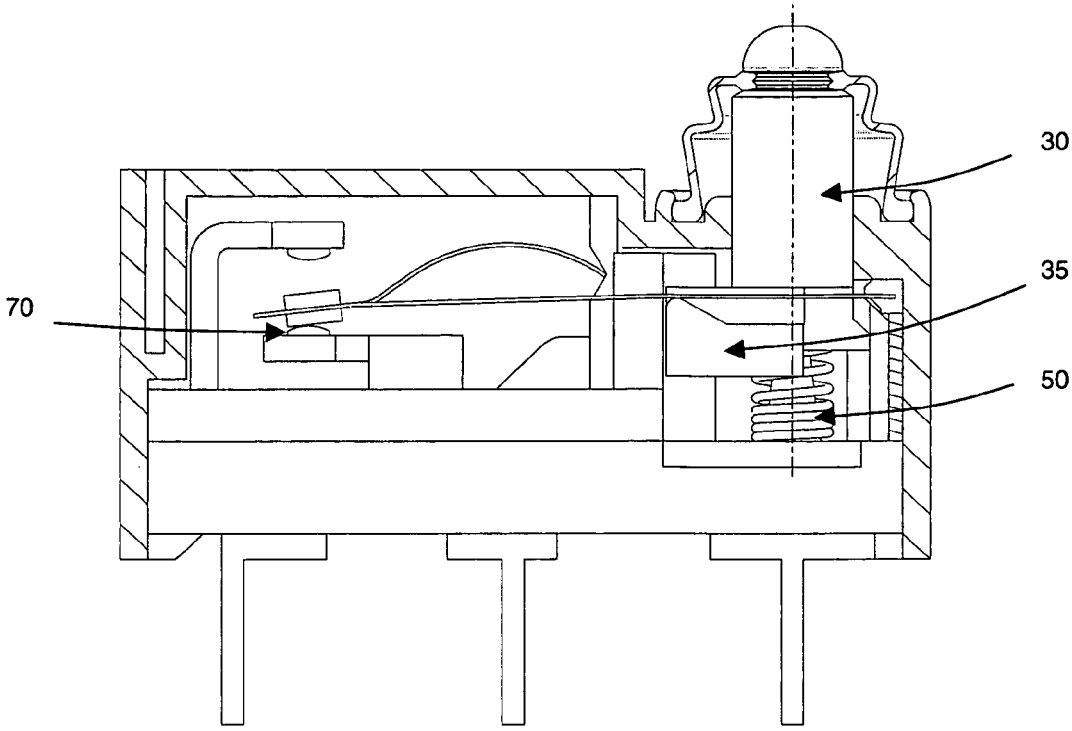
FIGS. 3 and 4 represent partial cross-sections of the miniswitch of FIG. 1 in the actuated position.
Figure 4:
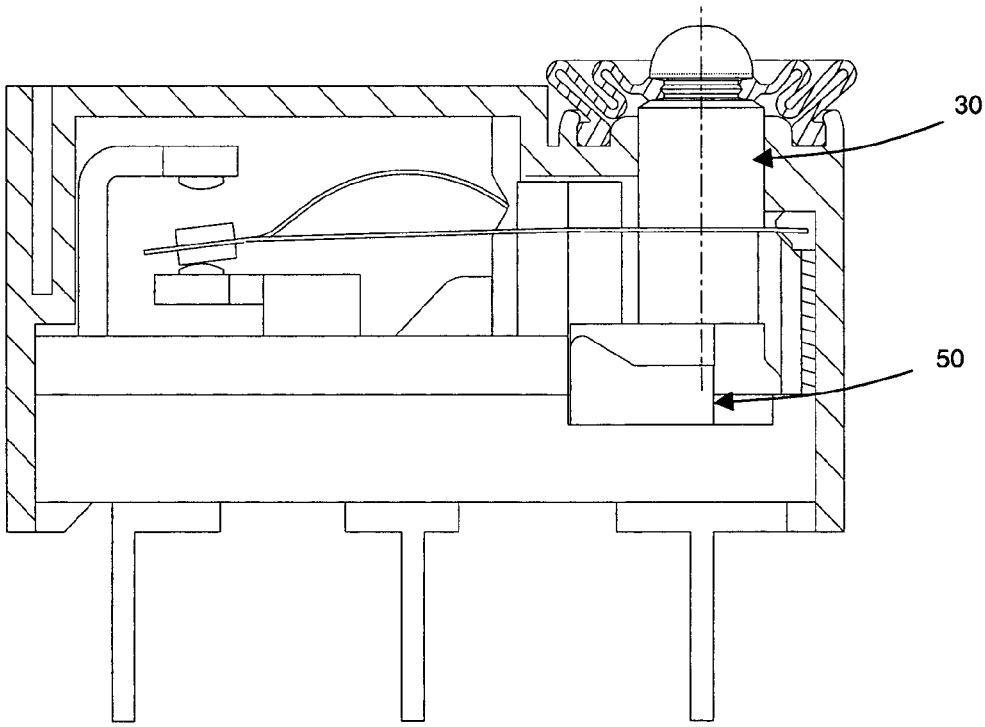
Figure 5:
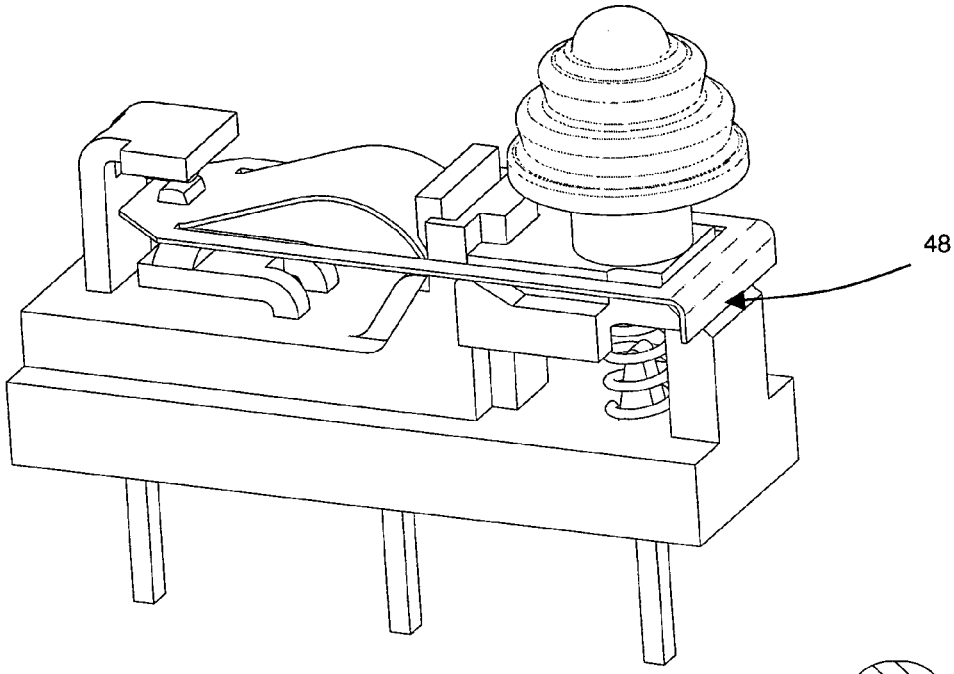
FIGS. 5 and 6 represent a second miniswitch according to the invention.
Figure 6:
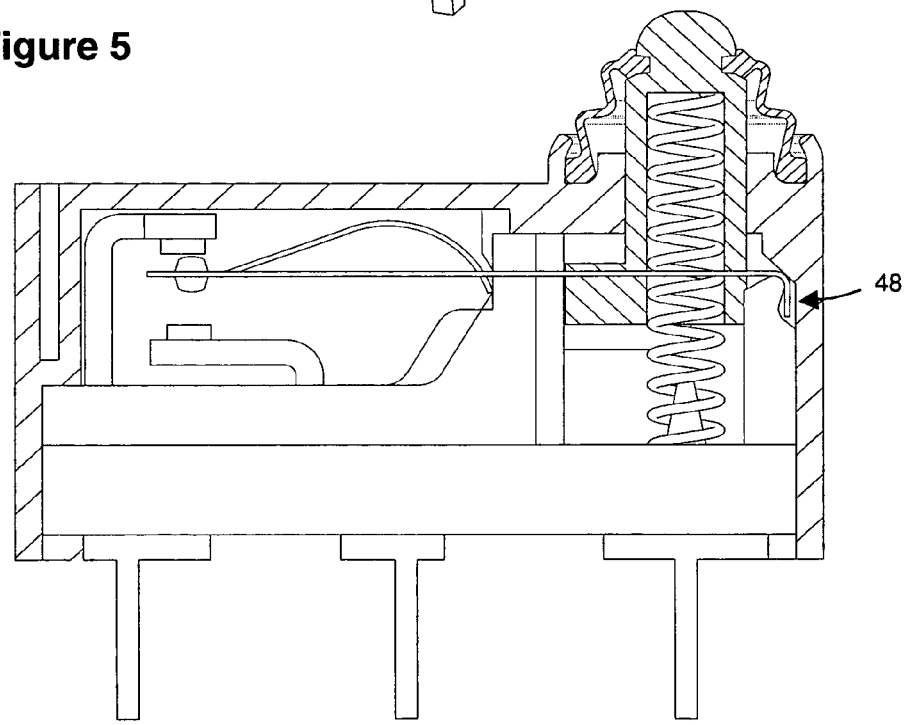
Figure 7:
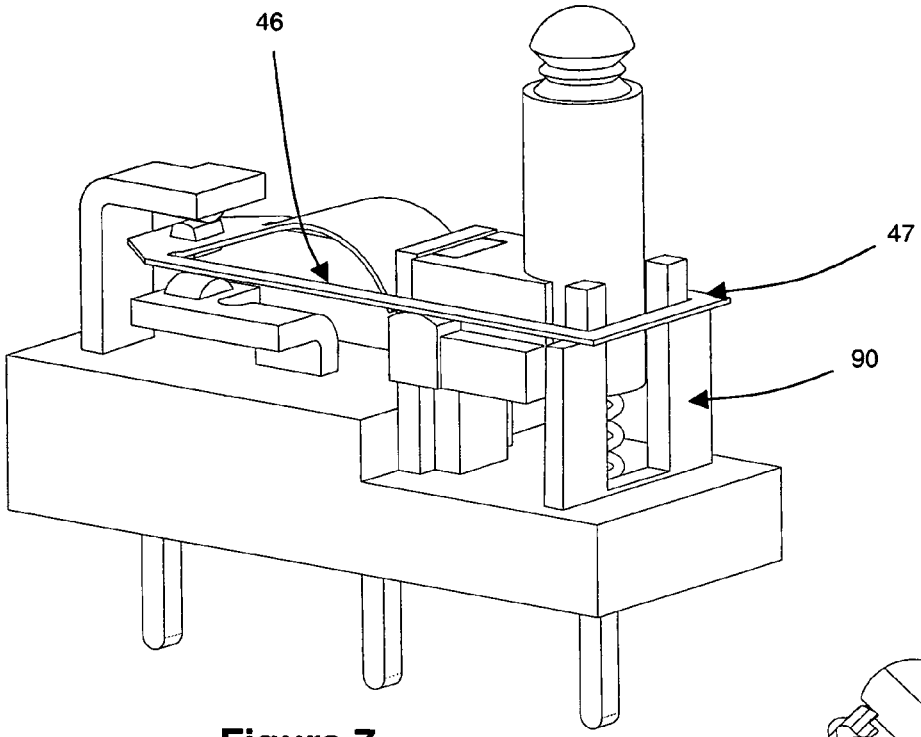
FIGS. 7 and 8 represent a third miniswitch according to the invention.
Figure 8:
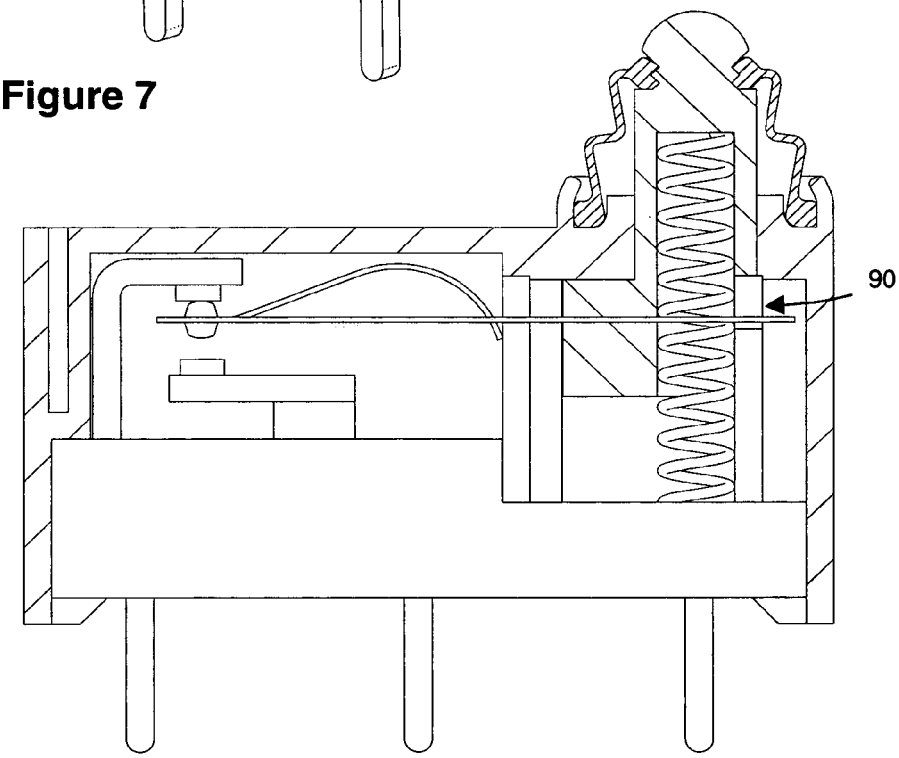

As represented in FIGS. 3 and 4, the push-button (30) is provided with at least one stop (35) pressing on a branch (46) of the flexible conducting blade (40) so as to exert a force on the blade (40), but only over a part of the travel of the push-button (30). Thus, in the break position of the miniswitch corresponding to FIG. 2, the compression spring (50) exerts a force greater than the pre-stress effect on the push-button (30), and therefore on its stop (35), so that it keeps the movable end of the flexible conducting blade (40) pressed against the contact (71) located farther from the case forming the base (10).

When the miniswitch is actuated, the push-button (30), as it is depressed, will progressively oppose the action of the compression spring (50) on the branch (46, 47) of the blade (40) until the flexible conducting blade (40) snaps to the switched position due to the pre-stress effect, as represented in FIG. 3. The travel of the push-button (30) can then be continued up to an extreme position represented in FIG. 4, compressing the spring (50), without the conducting blade (40) being subjected to any further force from the push-button (30).

The flexible blade (40) undergoes very little fatigue as its scope of movement is very small, and it is only subjected to limited forces, which ensures a very high mechanical endurance and an excellent reliability of the high-speed break mechanism performing the switching function. In addition, the small scope of movement also limits the friction between the fixed contact(s) (70, 71) connected to the terminals (11, 12) of the miniswitch and the contact(s) placed at the movable end of the flexible blade (40), thus ensuring a high electrical reliability on account of the reduced wear of the contacts, in particular of the surface treatments. Finally, the forces exerted by the push-button (30) on the blade (40) are parallel to the axis of the push-button (30) and do not induce any friction when sliding of the latter takes place.

Consequently, the push-button (30) of the miniswitch has a large over-travel by simple compression of the spring (50), which guarantees a high mechanical endurance and an excellent reliability of the device, without having the drawbacks of miniswitches according to the prior art.

The push-button (30) preferably passes through the recess separating the two branches (46, 47) of the flexible conducting blade (40), to balance the mechanical forces, to simplify the construction of the device and to reduce the dimensions thereof.

Preferably, one end of the compression spring (50) is placed in a recess provided in the push-button (30) as represented in FIG. 2. The spring (50) enters the recess as it is compressed by the push-button (30). In this way it is possible to obtain a maximum travel for the push-button (30) in relation to the dimensions of the miniswitch.

Optionally, for example if this is imposed by the environment in which the miniswitch is to be used, a seal (80) can be used as represented in FIG. 2 to ensure the tightness of the device around the push-button (30). A seal or other non-represented tightness devices can then also be placed between the part of the case forming the base (10) and the part of the case forming the cover (20).

FIGS. 5, 6 and 7, 8 correspond respectively to FIGS. 1 and 2, for two embodiments illustrating alternative solutions to pre-stress the flexible conducting blade (40). In the embodiment represented in FIGS. 5 and 6, the branches (46, 47) of the flexible blade (40) are terminated by a securing fold (48) that rests on a protuberance of the part of the case forming the base. In the embodiment represented in FIGS. 7 and 8, the branches (46, 47) of the flexible (40) blade join one another and rest on one or more uprights (90) that are either placed on an add-on part or form part of the case forming the base (10) or form part of the terminal (13).

FIGS. 5 to 8 also enable it to be illustrated that the invention applies whatever the shape of the elements connected to the terminals (11, 12) and bearing the fixed contacts (70, 71) when these are present.

What is claimed is:

1. An electrical miniswitch having a break position and a make position, comprising:

a case comprising a cover and a base, a plurality of electrical terminals extending from the base, a first electrical contact and a second electrical contact both located within the case;

a high-speed breaking mechanism located within the case and comprising a flexible conducting blade comprising a tongue, a push-button comprising a stop mechanism, and a compression spring, wherein the flexible conducting blade is pre-stressed biasing it towards the first electrical contact, and the push-button is mounted to slide through the cover to actuate the high-speed breaking mechanism, the compression spring opposing sliding of the push-button, such that when the miniswitch is in the break position, the push-button stop mechanism exerts a transverse force on the flexible conducting blade permitting the pre-stressed flexible conducting blade to contact the first electrical contact, and when the push-button is in the make position, the stop does not exert force on the flexible conducting blade, permitting the biased flexible conducting blade to contact the second electrical contact.

2. An electrical miniswitch according to claim 1, wherein one of the ends of the flexible blade is fixed and the other end is movable and provided with at least one contact.

3. An electrical miniswitch according to claim 1, wherein the push-button passes through the flexible conducting blade.

4. An electrical miniswitch according to claim 1, wherein one end of the compression spring is housed in a recess in the push-button.

5. An electrical miniswitch according to claim 1, wherein the flexible conducting blade is pre-stressed between two notches located in the case.

6. An electrical miniswitch according to claim 1, wherein the flexible conducting blade is pre-stressed, one edge of the tongue being located in a notch in the case and a retaining fold in the blade adjacent a longitudinally opposite edge thereof.

* * * * *